US010113121B2

(12) United States Patent
Pigourier et al.

(10) Patent No.: US 10,113,121 B2
(45) Date of Patent: Oct. 30, 2018

(54) GASOLINE PRODUCTION PROCESS COMPRISING AN ISOMERIZATION STEP FOLLOWED BY AT LEAST TWO SEPARATION STEPS

(71) Applicant: AXENS, Rueil Malmaison (FR)

(72) Inventors: Jerome Pigourier, Meudon (FR); Isabelle Prevost, Rueil Malmaison (FR); Laurent Watripont, Nanterre (FR); Pierre-Yves Martin, Rueil Malmaison (FR)

(73) Assignee: AXENS, Rueil Malmaison (FR)

( * ) Notice: Subject to any disclaimer, the term of this patent is extended or adjusted under 35 U.S.C. 154(b) by 95 days.

(21) Appl. No.: 15/307,593

(22) PCT Filed: Apr. 20, 2015

(86) PCT No.: PCT/EP2015/058498

§ 371 (c)(1),
(2) Date: Oct. 28, 2016

(87) PCT Pub. No.: WO2015/165763

PCT Pub. Date: Nov. 5, 2015

(65) Prior Publication Data

US 2017/0044447 A1 Feb. 16, 2017

(30) Foreign Application Priority Data

Apr. 29, 2014 (FR) ..... 14 53841

(51) Int. Cl.

| | |
|---|---|
| ***C10G 61/02*** | (2006.01) |
| ***C10G 45/58*** | (2006.01) |
| ***C10L 1/06*** | (2006.01) |
| ***C10G 7/00*** | (2006.01) |

(52) U.S. Cl.

CPC ..... *C10G 61/02* (2013.01); *C10G 7/00* (2013.01); *C10G 45/58* (2013.01); *C10L 1/06* (2013.01); *C10G 2300/104* (2013.01); *C10G 2300/1044* (2013.01); *C10G 2400/02* (2013.01); *C10L 2200/0423* (2013.01); *C10L 2290/543* (2013.01)

(58) Field of Classification Search

CPC ..... C10G 61/02; C10G 45/58; C10G 7/00; C10G 2400/02; C10G 2300/104; C10G 2300/1044; C10L 1/06; C10L 2290/543; C10L 2200/0423

See application file for complete search history.

(56) References Cited

U.S. PATENT DOCUMENTS 3,131,235 A * 4/1964 Asselin ..... C07C 9/16 585/737
2010/0025221 A1* 2/2010 Agrawal ..... B01D 3/143 203/82

OTHER PUBLICATIONS

Stephen Lindsay, Very High Purity Aluminum: An Historical Perspective, JOM, Feb. 2014, vol. 66, issue 2, pp. 217-222 (Year: 2014).*

* cited by examiner

*Primary Examiner* — Randy Boyer
*Assistant Examiner* — Juan C Valencia
(74) *Attorney, Agent, or Firm* — Millen, White, Zelano, Branigan, P.C.

(57) ABSTRACT

The present invention describes a process for the production of high octane number gasoline by isomerization of a light naphtha cut, comprising two separation steps located downstream of the reaction step which can be used to improve the energy efficiency of said process.

8 Claims, 6 Drawing Sheets

GASOLINE PRODUCTION PROCESS COMPRISING AN ISOMERIZATION STEP FOLLOWED BY AT LEAST TWO SEPARATION STEPS

FIELD OF THE INVENTION

The invention relates to the field of the production of high octane number gasoline. Naphthas obtained from the atmospheric distillation of oil are normally principally constituted by hydrocarbons containing 5 to 10 carbon atoms (C5-C10 cuts). These naphthas are generally fractionated into a light naphtha cut (C5-C6 cut) and a heavy naphtha cut (C7-C10). The heavy naphtha cut is usually sent to a catalytic reforming process. The light naphtha cut, which essentially comprises hydrocarbons containing 5 or 6 carbon atoms (C5 and C6), but may additionally comprise hydrocarbons containing 4 or 7 or even 8 carbon atoms (C4, C7, C8), is generally isomerized in order to increase the proportion of branched hydrocarbons, which have a higher octane number than straight chain hydrocarbons.

The isomerate and the reformate obtained are then sent to the gasoline pool with other bases or additives (catalytically cracked gasoline, alkylates, etc.). Because of the steady reduction in the maximum quantity of aromatic compounds allowed in gasolines (less than 35% by volume in the Euro 5 regulation, for example), and the large quantities of aromatics in catalytically reformed gasolines, the importance of isomerates in the gasoline pool which do not contain aromatic compounds is increasing.

Thus, it is important to provide high-performance isomerization processes, both in terms of yield and in terms of octane number. These processes must also be of economic interest both as regards the level of investment and as regards operating costs. Thus, it is important to optimize the function of the isomerization reaction section and sections for fractionation of the feed or the effluent.

EXAMINATION OF THE PRIOR ART

Patent FR 2 828 205 describes a process for the isomerization of a C5-C8 cut, in which said cut is fractionated into a C5-C6 cut and a C7-C8 cut which are each isomerized separately under conditions specific to each cut.

U.S. Pat. No. 2,905,619 describes an isomerization process in which the C5-C6 cut obtained from a gasoline cut is separated into different fractions which are isomerized in two isomerization sections operated under specific conditions.

U.S. Pat. No. 7,233,898 describes an isomerization process with a fractionation section which just comprises stabilization or stripping and a deisohexanizer producing 2 to 4 different cuts. These process layouts do not include a deisopentanizer (DiP) and/or depentanizer (DP).

Patent GB 1 056 617 describes a process for the isomerization of a C5-C6 cut comprising a deisopentanizer (denoted DiP), an isomerization of the isopentane-depleted cut (ISOM), a separation of the isomerized effluent in order to recover n-pentane (DP) which is recycled with the feed to the inlet to the deisopentanizer, and a separation of the branched C6 hydrocarbons (deisohexanizer) (denoted DiH), in order to recover branched C6 hydrocarbons with a high octane number, the complement being recycled to the isomerization reactor. That DiP/ISOM/DP/DiH layout corresponds to FIG. 1 (in accordance with the prior art) in this application.

These numerals are retained in the figures in accordance with the invention to designate the same equipment.

Figure 2:
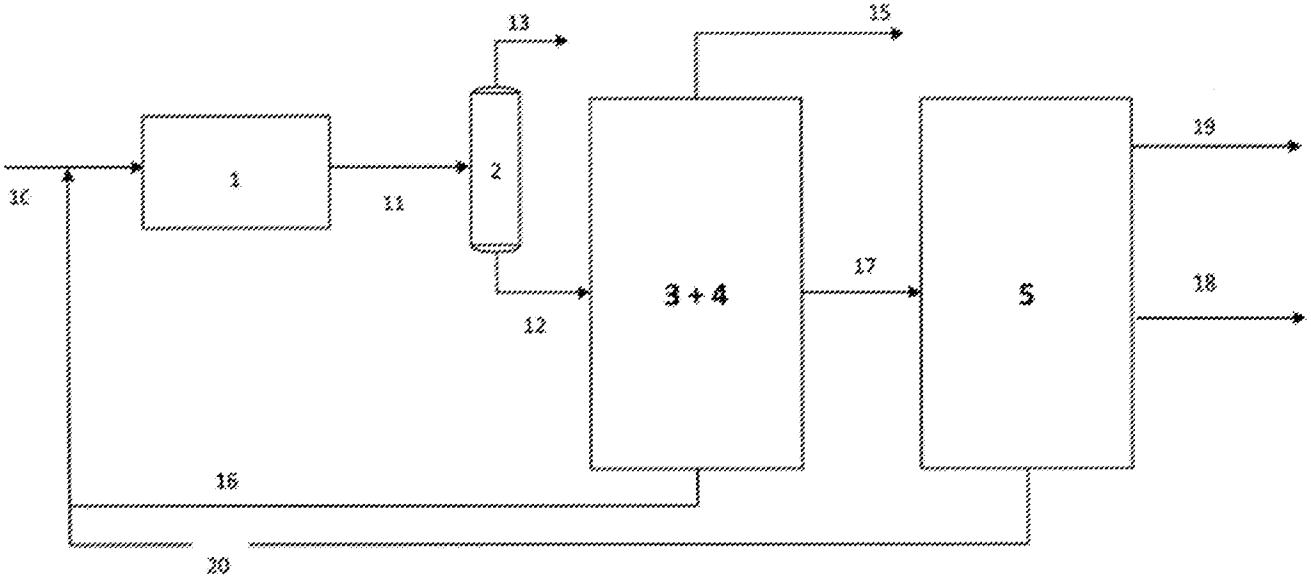

FIG. 2 represents the process in accordance with the invention, in which the block denoted (3+4) represents the first separation step, and the block [5] represents the second separation step.

Figure 3:
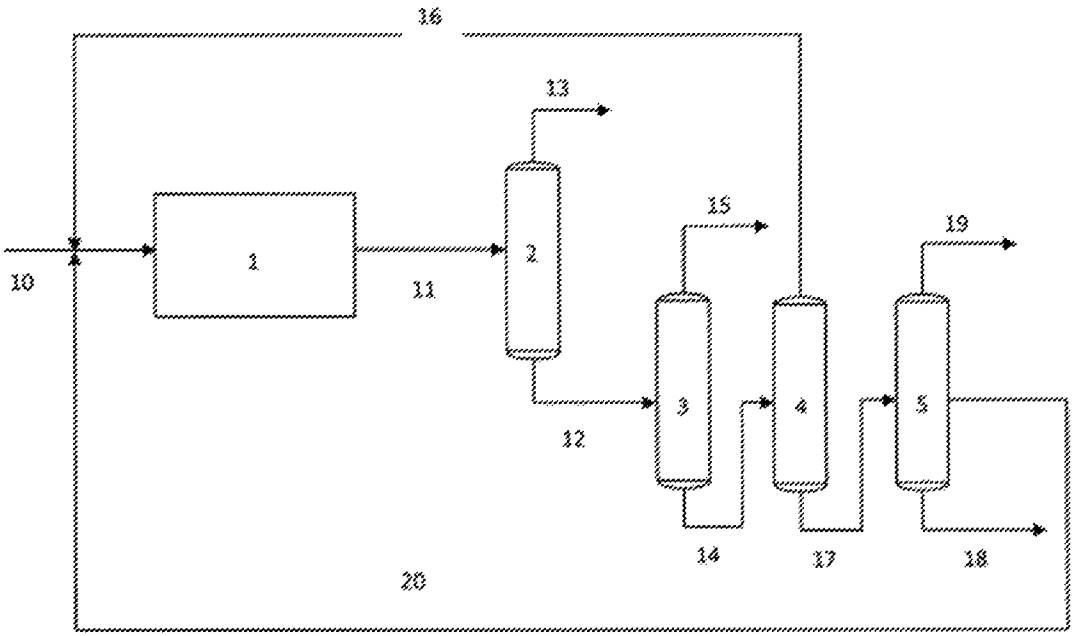

FIG. 3 represents a first variation of the process in accordance with the invention, in which the columns [3] and [4] are connected up in series.

Figure 4:
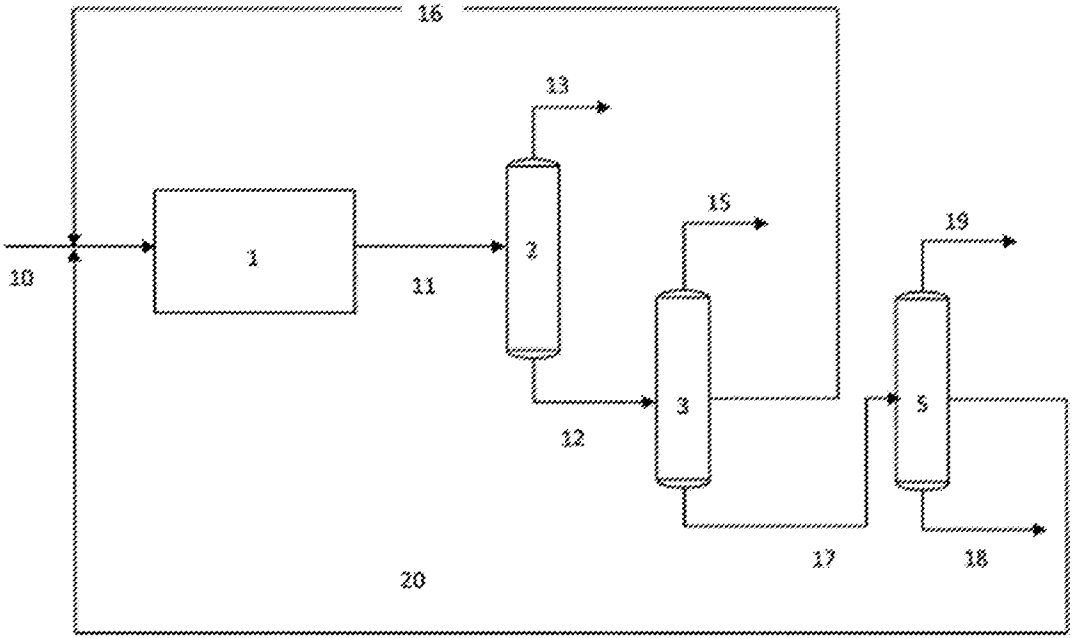

FIG. 4 represents a second variation of the process in accordance with the invention, in which the columns [3] and [4] are combined into a single column [3] in order to enable fractionation into 3 cuts.

Figure 5:
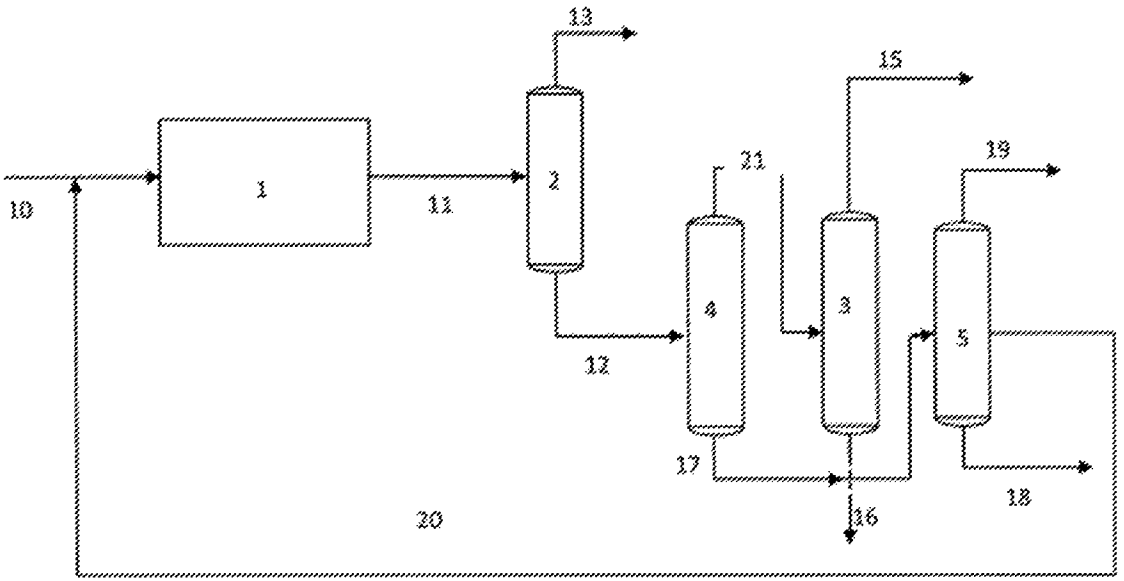

FIG. 5 represents a third variation of the process in accordance with the invention, in which the columns [3] and [4] are in the reverse order, i.e. the overhead stream from column [4] is supplied to column [3].

Figure 6:
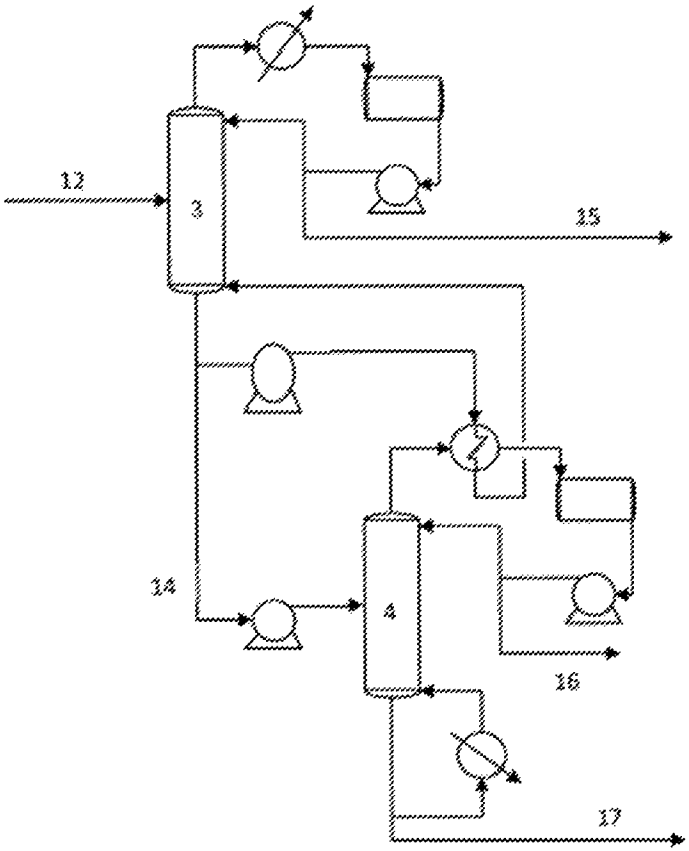

FIG. 6 represents an example of thermal integration between the condenser of a first column and the reboiler of another column.

The equipment is denoted by numerals in square brackets and the streams by numerals in round brackets. The numerals for the conduits transporting the streams are the same as those of the transported streams.

BRIEF DESCRIPTION OF THE INVENTION

The invention concerns the field of the production of high octane number gasoline. The naphthas obtained from the atmospheric distillation of oil are usually principally constituted by hydrocarbons containing 5 to 10 carbon atoms (C5-C10 cut).

The process in accordance with the present invention treats a light naphtha type feed and preferably a C5-C6 cut (cut of hydrocarbons containing 5 or 6 carbon atoms), and is intended to maximize the branched molecules compared with the straight chain molecules (or normal molecules). However, these feeds may optionally comprise other hydrocarbons, for example hydrocarbons containing 4 or 7, or even 8 carbon atoms (C4, C7, C8 cuts). However, preferably, the aim should be to limit the quantity of these hydrocarbons, for example by means of a prior separation.

Regarding the C4 hydrocarbons, they may also be separated to a large extent in the stabilization column [2].

The process in accordance with the invention is more particularly applicable to feeds wherein the isopentane content is less than 25% and preferably less than 20%.

The process in accordance with the invention comprises an isomerization section [1], a stabilization of the isomerized effluent [2] (denoted STAB), a separation of isopentane (denoted DiP), a separation of n-pentane (denoted DP) (represented by the block 3+4) and a separation of the remaining products, in particular C6 branched compounds (denoted DiH) (represented by the block 5), in accordance with the sequence ISOM/STAB/DiP/DP/DiH.

In the process in accordance with the invention, the separation of isopentane and n-pentane may also be carried out in one and the same column allowing fractionation into 3 cuts in accordance with the sequence ISOM/STAB/DiP/DiH in accordance with FIG. 4.

The process in accordance with the invention is thus distinguished from the process in accordance with the prior art (FIG. 1) in that it comprises the successive separation of isopentane, n-pentane and branched C6 compounds in this order in accordance with FIG. 3, or the simultaneous separation of n-pentane and isopentane in one and the same fractionation column in accordance with FIG. 4, followed by separation of the C6 branched compounds, or indeed separation of a C5 cut, than that of n-pentane and isopentane and that of the branched C6 compounds in accordance with FIG. 5.

Figure 1:
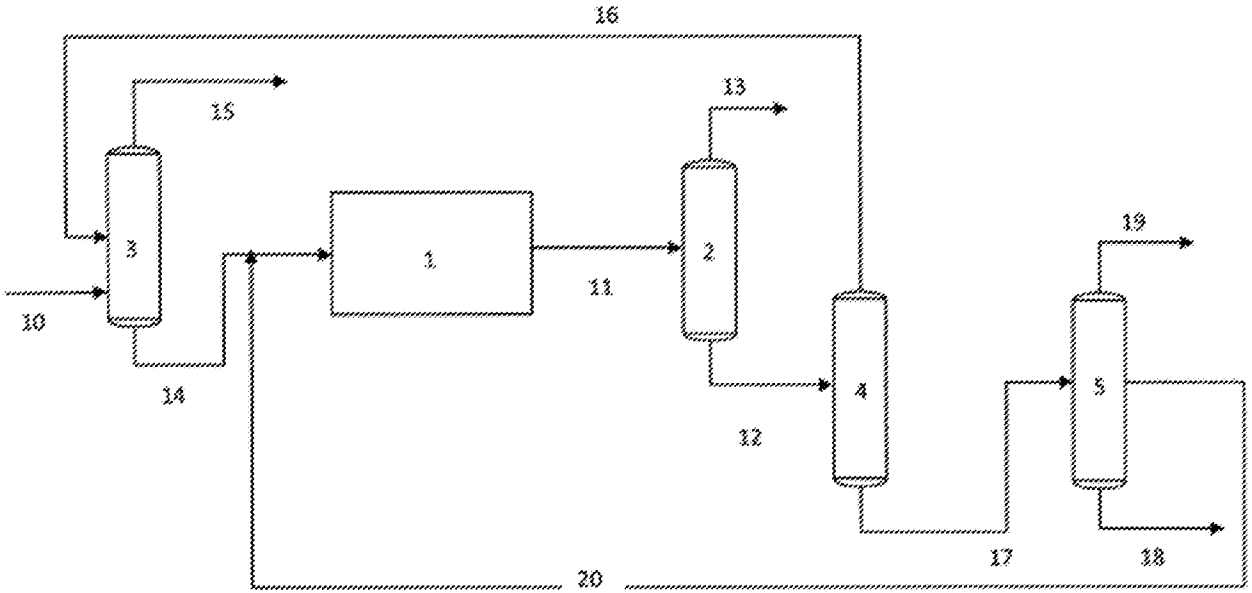
FIG. 1 represents a prior art layout in accordance with the closest prior art. This layout highlights the deisopentanizer column [3], the isomerization reaction section [1], the stabilization column [2], the depentanizer column [4] and the deisohexanizer column [5].

In the process in accordance with the invention, said separations are all located downstream of the isomerization section [1], and more precisely downstream of the stabilization column [2], in contrast to prior art processes which have only one DiH column (deisohexanizer), or 3 fractionation columns, but with the DiP (deisopentanizer) column located upstream of the isomerization section in accordance with the layout of FIG. 1.

More precisely, the present invention may be described as a process for the isomerization of a light naphtha, or preferably of an essentially C5-C6 cut, said process comprising two steps for separation by distillation located downstream of the isomerization step:

- a first step for separation by distillation (block 3+4) in order to separate the hydrocarbons containing 5 carbon atoms from heavier compounds sent towards the second separation section [5]. This first separation step consists of producing the following 3 cuts: a) a cut which is enriched in isopentane (15) which is a product of the process, b) a cut which is enriched in n-pentane (16) which is recycled to the reaction section [1], and c) a cut which is enriched in hydrocarbons which are heavier than pentanes (17) which is directed towards a second separation step [5],
- a second separation step [5], consisting of a separation column wherein the overhead and bottom products are the products from the unit, namely an overhead stream (19) which is rich in C6 branched compounds, a bottom stream (18), and an intermediate cut (20) which is enriched in n-hexane, removed as a side stream which is recycled to the reaction section [1].

In accordance with a first variation of the process in accordance with the invention, represented by FIG. 3, the first separation step comprises two columns (3 and 4) disposed in series, i.e. the bottom stream from the deisopentanizer [3] is supplied to the depentanizer [4], as represented in FIG. 3. The stream of isopentane (15) leaves from the head of the column [3] and the stream of hydrocarbons which are heavier than pentanes (17) leaves from the bottom of the column [4] in order to supply the second step for fractionation [5].

In accordance with a second variation of the process in accordance with the invention, represented in FIG. 4, the deisopentanizer and the depentanizer are combined into a single column which can be used for fractionation into 3 streams (denoted [3] in FIG. 4). The stream of isopentane (15) leaves the column [3] overhead and the stream of hydrocarbons which are heavier than pentanes (17) leaves from the bottom of said column in order to be supplied to the second step for fractionation, [5]. An intermediate withdrawal (stream 16) is recycled to the isomerization unit [1].

In accordance with a third variation of the process in accordance with the invention, represented in FIG. 5, the first separation step comprises the two columns [4] and [3] disposed in series in this order. That is to say, the stream (12) obtained from the bottom of the stabilization column [2] is supplied to the depentanizer [4] from which an overhead stream (21) leaves which is supplied to the deisopentanizer [3]. The bottom stream (17) from the depentanizer [4] is supplied to the deisohexanizer [5]. The deisopentanizer [3] produces the overhead stream (15) which is rich in isopentane, and the stream (16) from the bottom, which is rich in normal pentane, which is recycled to the isomerization [1].

In accordance with other variations of the process, it is possible to use the heat available at the condenser of one of columns [3], [4] or [5] to supply heat to the reboiler of one of columns [3], [4] or [5]. As an example, in the variation illustrated in FIG. 6, it is possible to carry out an exchange of heat between the condenser of the depentanizer [4] and the reboiler of the deisopentanizer [3].

DETAILED DESCRIPTION OF THE INVENTION

In the process in accordance with the invention, the feed (10) is generally constituted by a light naphtha, preferably a C5-C6 cut, which may optionally contain heavier hydrocarbons. This feed is sent to a catalytic isomerization section [1], then the effluent (11) is fractionated in a fractionation section comprising the following steps:

- a stabilization [2] of the isomerized effluent, which consists of separating the compounds which are heavier than pentanes overhead (stream 13), and a stabilized effluent (12) from the bottom,
- a first step for separation by distillation (block 3+4) in order to separate the hydrocarbons containing 5 carbon atoms from heavier compounds sent towards the second separation section [5]. This first separation step consists of producing the following 3 cuts: a) a cut which is enriched in isopentane (15) which is a first product of the process, b) a cut which is enriched in n-pentane (16) which is recycled to the reaction section [1], and c) a cut which is enriched in hydrocarbons which are heavier than pentanes (17) which is directed towards a second separation step [5],
- a second separation step [5], consisting of a separation column wherein the overhead and bottom products are the products from the unit, namely an overhead stream (19) which is rich in C6 branched compounds, a bottom stream (18), and an intermediate cut (20) which is enriched in n-hexane, removed as a side stream which is recycled to the reaction section [1].

The cut which is enriched in isopentane (15) obtained from the first separation step as well as the overhead (19) and bottom (18) streams obtained from the second separation step may then optionally be mixed in order to provide the process product or products.

Description of FIG. 1, in Accordance with the Prior Art

FIG. 1 shows the layout for the process in accordance with the prior art which may be considered to be that closest to the present invention.

The feed (10) is supplied to a deisopentanizer [3] which can produce an overhead stream of isopentane (15). The bottom stream (14) from the deisopentanizer [3] is sent to the isomerization reaction section [1] via the conduit 14.

The operating conditions for this reaction section [1] are selected in a manner such as to favour the transformation of n-paraffins with a low octane number (n-pentane, n-hexane) into iso-paraffins with a higher octane number (isopentane, 2,2-dimethylbutane, 2,3-dimethylbutane, 2-methylpentane, 3-methylpentane).

The isomerization reaction section [1] is generally operated in the presence of an acidic catalyst.

The effluent from the isomerization section [1], once stabilized by separation of the light compounds (13) in the stabilization column [2], is directed to a depentanizer [4] via the conduit (12). The overhead stream (16) from the depentanizer [4] is recycled to the column [3] of the deisopentanizer.

Recycling n-pentane, the overhead product from the depentanizer [4], via the conduit (16) to the deisopentanizer [3] means that the proportion of n-pentane isomerized in the isomerization section [1] can be increased, and as a consequence, products with higher octane numbers can be obtained.

The stream (16) may be recycled to the deisopentanizer [3], either by introducing it alone directly into the deisopentanizer [3] (in accordance with FIG. 1) or as a mixture with the feed 10 (not shown). The stream (16) also contains isopentane formed in the isomerization section which is separated in the deisopentanizer [3].

The products (18) and (19) are respectively obtained from the bottom and the head of the deisohexanizer [5] which is supplied with the bottom stream (17) obtained from the depentanizer [4]. Isopentane is substantially absent from these two streams, as it is essentially present in the stream (15).

The process of FIG. 1 suffers from the disadvantage that a fluid which is enriched in isopentane recycled via the conduit (16) is mixed with the feed (10) obtained from the conduit (10), either before it is admitted into the deisopentanizer [3] or, as can be seen in FIG. 1, inside said deisopentanizer [3].

This mixture involves significant investment and operational costs, since it is then necessary to separate this isopentane again during the isopentane/n-pentane separation of the deisopentanizer [3], and during the n-pentane/heavier compounds separation of the depentanizer [4]. This is the more particularly problematic when the feed contains only a little isopentane. The process in accordance with the invention can be used, inter alia, to overcome this problem.

Description of Figures in Accordance with the Invention (FIGS. 2, 3, 4 and 5)

In its most general form, the process in accordance with the invention comprises:

a) a catalytic isomerization section [1] operated under the conditions described below, b) a stabilization of the isomerized effluent (11) in a stabilization column [2], which consists of separating the compounds which are lighter than the pentanes overhead, and a stabilized effluent (12) from the bottom, c) a first step for separation carried out in the distillation block (3+4) in order to separate the hydrocarbons containing 5 carbon atoms from heavier compounds sent to the second separation section. This first separation step consists of producing the following 3 cuts by using one or two fractionation columns:

- a cut which is enriched in isopentane (15) which is a product of the process,
- a cut which is enriched in n-pentane (16) which is recycled to the reaction section [1], and
- a cut which is enriched in hydrocarbons which are heavier than pentanes (17), which is directed towards a second separation step [5].

A second separation step [5], which may preferably be carried out using a deisohexanizer consisting of a separation column wherein the overhead product (19) is rich in C6 branched compounds, and an intermediate cut (20) which is enriched in n-hexane, removed as a side stream which is recycled to the reaction section [1]. The stream which is enriched in isopentane (14), the bottom product (18) and the overhead product (19) may be mixed in order to constitute the product or products from the process.

The isomerization reaction is preferably carried out in the presence of a high activity catalyst such as, for example, a catalyst based on chlorinated alumina and platinum, functioning at low temperatures, for example in the range 100° C. to 300° C., preferably in the range 110° C. to 240° C., at high pressures, for example 2 to 35 bar (1 bar=0.1 MPa), and with a low hydrogen/hydrocarbons molar ratio which is, for example, in the range 0.1/1 to 1/1. The known catalysts which may be used are preferably constituted by an alumina support and/or high purity support preferably comprising 2% to 10% by weight of chlorine, 0.1% to 0.40% by weight of platinum, and optional other metals. These catalysts may be employed using a space velocity of 0.5 to 10 $h^{-1}$, preferably 1 to 4 $h^{-1}$.

Maintaining the degree of chlorination of the catalyst generally necessitates the continuous addition of a chlorinated compound such as carbon tetrachloride, which is injected as a mixture with the feed at a concentration which is from 50 to 600 parts per million by weight.

The isomerization catalysts for the process in accordance with the invention may preferably be included in the group constituted by:

- supported catalysts, most usually supported by a mineral support, typically an oxide (for example an aluminium oxide or silicon oxide or a mixture thereof) and containing at least one halogen and a metal from group VIII,
- zeolitic catalysts containing at least one metal from group VIII,
- Friedel-Crafts type catalysts,
- acidic or super-acidic catalysts, for example of the heteropolyanion (HPA) on zirconia, oxides of tungsten on zirconia or sulphated zirconia type.

The isomerization reaction is preferably operated in the presence of a high activity catalyst such as, for example, a catalyst based on chlorinated alumina and platinum functioning at low temperatures, for example between 100° C. and 300° C., preferably between 110° C. and 240° C., at high pressures, for example in the range 2 to 35 bar (1 bar=0.1 MPa) and with a low molar ratio of hydrogen/hydrocarbons in the range, for example, 0.1/1 to 1/1.

Preferred catalysts which are used are constituted by a high purity alumina support which preferably comprises 2% to 10% by weight of chlorine, 0.1% to 0.40% by weight of platinum and optional other metals.

They may be used at a space velocity in the range 0.5 to 10 $h^{-1}$, preferably in the range 1 to 4 $h^{-1}$.

Maintaining the degree of chlorination of the catalyst generally necessitates continuously adding a chlorinated compound such as carbon tetrachloride, which is injected as a mixture with the feed at a concentration which is preferably in the range 50 to 600 parts per million by weight.

Other catalysts with an acidity comparable to these catalysts may also be used.

In accordance with a first variation of the process in accordance with the invention (represented by FIG. 3), the feed is sent to the isomerization section [1] via the conduit (10).

The conditions for the isomerization section [1] are selected in a manner such as to favour the transformation of n-paraffins with a low octane number (n-pentane, n-hexane) into iso-paraffins with a higher octane number (isopentane, 2,2-dimethylbutane, 2,3-dimethylbutane, 2-methylpentane, 3-methylpentane).

The effluent (11) from the isomerization section, once stabilized by separation of the light compounds in the stabilization column [2], is then directed via the conduit (12) to a deisopentanizer [3] in a manner such as to recover overhead, via the conduit (15), a stream which is enriched in isopentane, and a fluid which is depleted in isopentane from the bottom via the conduit (14).

The fractionation conditions for the deisopentanizer [3] are preferably such that the degree of recovery of isopentane overhead (flow rate of isopentane overhead from the deisopentanizer divided by the flow rate of isopentane in the feed for the deisopentanizer) is typically more than 70%. The n-pentane content in the overhead product (15) is thus typically less than 15% by weight, preferably less than 10% by weight.

The bottom product from the deisopentanizer [3] is directed via the conduit (14) towards a depentanizer [4] so as to recover overhead a fluid (stream 16) which is enriched in n-pentane and which contains very little isopentane, which is recycled to the isomerization reaction section [1] via the conduit (16). A stream (17) principally containing hydrocarbons containing 6 or more carbon atoms (C6+ cut) is recovered from the bottom via the conduit (17) and supplied to the deisohexanizer [5].

The deisohexanizer [5] consists of a separation column wherein the overhead product (19) is rich in C6 branched compounds, and wherein an intermediate cut (20) enriched in n-hexane removed as a side stream is recycled to the reaction section [1].

The stream which is enriched in isopentane (14), the bottom product from the deisohexanizer [5], and the overhead product from the deisohexanizer (19) may be mixed in order to constitute the product or products from the process.

The dimensions of the fractionation column [4] and the fractionation conditions are preferably such that the overall degree of n-pentane recovery (flow rate of n-pentane overhead from the depentanizer [4] divided by the flow rate of n-pentane at the outlet from the isomerization reaction section [1]) is typically more than 80%. The quantity of hydrocarbons containing 6 or more carbon atoms from the depentanizer [4] is typically less than 15%, preferably less than 10% by weight.

Compared with the prior art illustrated in FIG. 1, this first variation reduces the energy consumption of the process because the isopentane produced in the isomerization reactor [1] is only vaporized once before being exported, and the deisopentanizer [3] fractionates a C5 cut which is enriched in iC5, which facilitates said separation.

In accordance with a second variation of the process in accordance with the invention (represented in FIG. 4)), the depentanizer [4] and the deisopentanizer [3] are replaced by a single column [3] which is a 3-cut deisopentanizer which can also be used to separate n-pentane.

- the overhead product (15) is a fluid which is enriched in isopentane,
- the intermediate stream (16), which is withdrawn as a side stream via the conduit (16), is a fluid which is enriched in n-pentane,
- the bottom product (17) is a fluid which is depleted in iso- and n-pentane essentially containing hydrocarbons containing more than 6 carbon atoms. This bottom stream (17) is supplied to the deisohexanizer [5]. The second separation step in the deisohexanizer is carried out in a manner identical to the first variation in accordance with the invention.

In accordance with a third variation of the process in accordance with the invention (represented in FIG. 5), the effluent from the isomerization reaction [1], once stabilized by separation of light compounds in the stabilization column [2], is directed via the conduit (12) to the depentanizer [4] in a manner such as to recover overhead, via the conduit (21), a C5 cut which is depleted in C6, and a fluid principally containing hydrocarbons containing 6 or more carbon atoms from the bottom via the conduit (17), which is supplied to the deisohexanizer [5]. The second separation step in the deisohexanizer is carried out in a manner identical to the first variation in accordance with the invention.

The C5 cut is supplied to the deisopentanizer [3] via the conduit (21), which means that isopentane (15) can be withdrawn overhead, and n-pentane (16) can be withdrawn from the bottom and recycled to the reaction section [1].

Thermal Integration

Like the prior art, the invention has other variations depending on the various types of thermal integration.

The principle of these thermal integrations consists of selected the operating pressure of a first column in a manner such that the condensation temperature at the head of this column is higher than the reboiling temperature of one or more other columns of the process.

The exchange of heat between the overhead condenser of the first column which has to be cooled and the bottom reboiler of another column which has to be heated thus at least partially or even completely substitutes for the consumption of the cold utilities at the head of the first column in order to cool it and for the hot utilities used at the bottom of the second column in order to heat it.

The terms "first column" and "other column" are generic, since the selection of the column with the highest condenser temperature is what defines it as the first column.

Thus, FIG. 6 represents an example of the mode of thermal integration between the depentanizer [4], which is considered to be the first column, and the deisopentanizer [3], which is considered to be the other column, in accordance with the first variation (shown in FIG. 3) of the process in accordance with the invention.

FIG. 6 thus presents an exchange of heat between the condenser of the column [4] (depentanizer) and the reboiler of the other column [3] (deisopentanizer). Any other pair of columns could be envisaged, for example integration between the condenser of the deisohexanizer [5] and the reboiler of the depentanizer [4], or indeed between the condenser of the deisohexanizer [5] and the reboiler of the deisopentanizer [3], or indeed between the condenser of the deisohexanizer [5] and the two reboilers of the depentanizer [4] and the deisopentanizer [3]. One of these columns may also comprise an intermediate withdrawal (3-cut fractionation column).

In summary, the invention concerns a process for the isomerization of a light naphtha, said process comprising an isomerization reaction step [1], followed by a step [2] for stabilization of the reaction effluents, and two steps for separation by distillation of the bottom stream obtained from the stabilization step [2]:

1—a first step for separation by distillation (block 3+4) in order to separate the hydrocarbons containing 5 carbon atoms from heavier compounds sent towards the second separation section [5], said first separation step producing the following 3 cuts: a) a cut which is enriched in isopentane (15) which is a product of the process, b) a cut which is enriched in n-pentane (16) which is recycled to the reaction section [1], and c) a cut which is enriched in hydrocarbons which are heavier than pentanes (17), which is directed towards a second separation step [5], 2—a second separation step [5], consisting of a separation column wherein the overhead and bottom products are the products from the unit, namely an overhead stream (19) which is rich in C6 branched compounds, a bottom stream (18), and an intermediate cut (20) which is enriched in n-hexane, removed as a side stream which is recycled to the reaction section [1].

Preferably, in the isomerization process in accordance with the invention, the first separation step comprises two columns, a deisopentanizer [3] and a depentanizer [4], disposed in series, i.e. the bottom stream (14) from the deisopentanizer [3] is supplied to the depentanizer [4], the stream of isopentane (15) leaves from the head of the column [3], and a stream enriched in hydrocarbons which are heavier than pentanes (17) leaves from the bottom of the column [4] and is supplied to the deisohexanizer [5], and the overhead stream (16) from the column [4] is recycled to the isomerization unit [1].

In accordance with another preferred variation of the isomerization process in accordance with the invention, the first separation step comprises just a single column [3], in which the stream of isopentane (15) leaves the column [3] overhead, the stream enriched in hydrocarbons which are heavier than pentanes (17) leaving from the bottom of said column [3] is supplied to the column of the deisohexanizer [5], and the intermediate withdrawal (stream 16) is recycled to the isomerization unit [1].

In accordance with another preferred variation of the isomerization process in accordance with the invention, the first separation step comprises the two columns [4] and [3] disposed in series in that order, in which the stream (12) obtained from the stabilization column [2] is supplied to the depentanizer [4] from which an overhead stream (21) leaves which is supplied to the deisopentanizer [3], and in which the bottom stream (17) from the depentanizer [4] which is enriched in hydrocarbons which are heavier than pentanes is supplied to the deisohexanizer [5], the deisopentanizer [3] producing the overhead stream (15) which is rich in isopentane, and from the bottom the stream (16), which is rich in normal-pentane, which is recycled to the isomerization unit [1].

In accordance with another preferred variation of the isomerization process in accordance with the invention, an exchange of heat is carried out between the condenser of one of the columns [3], [4] or [5] and the reboiler of one of the columns [3], [4] or [5]. In accordance with a first embodiment of this variation, the exchange of heat is carried out between the condenser of the deisohexanizer [5] and either the reboiler of the depentanizer [4] or the reboiler of the deisopentanizer [3], or both. In accordance with a second embodiment, the exchange of heat is carried out between the condenser of the depentanizer [4] and the reboiler of the deisopentanizer [3].

EXAMPLES IN ACCORDANCE WITH THE INVENTION

Example 1

This example is based on the feed (10) with the detailed composition given in Table 1 below:

TABLE 1

| Composition of the feed | | |
|---|---|---|
| Mass flow rate | kg/h | 37249 |
| isobutane | % by wt | 0% |
| n-butane | % by wt | 0% |
| isopentane | % by wt | 3% |
| n-pentane | % by wt | 27% |
| 2,2-dimethyl-butane | % by wt | 1% |
| 2,3-dimethyl-butane | % by wt | 3% |
| 2-methyl-pentane | % by wt | 15% |
| 2-methyl-hexane | % by wt | 12% |
| n-hexane | % by wt | 27% |
| cyclopentane | % by wt | 2% |
| methyl-cyclopentane | % by wt | 5% |
| benzene | % by wt | 2% |
| cyclohexane | % by wt | 2% |

The reaction section was constituted by 2 isomerization reactors operating in series. The inlet temperature for the two reactors was 120° C.

The inlet pressure of reactor 1 was 35 bar absolute.

The inlet pressure for the second reactor was 33 bar absolute.

The catalyst employed was constituted by an alumina support comprising 7% by weight of chlorine, and 0.23% by weight of platinum and optional other metals.

The space velocity was 2.2 $h^{-1}$. The molar ratio of hydrogen to hydrocarbon was 0.1/1.

The operating pressures for the columns were selected in a manner such that the overhead temperature was compatible with the cooling means which are usually available (cooling water or air at ambient temperature).

The recycle ratio for the pentanes is defined as the flow rate of fluid enriched in n-pentane recycled to the isomerization reaction section divided by the flow rate of fresh feed.

The recycle ratio for the hexanes is defined as the flow rate of fluid enriched in n-hexane recycled to the isomerization reaction section divided by the flow rate of fresh feed.

Both for the process in accordance with the prior art represented in FIG. 1 and for the process in accordance with the invention represented in FIGS. 3 and 4, the recycle ratios for the pentanes and hexanes were selected in a manner such as to obtain a constant flow rate in the isomerization reaction section [1], which corresponded to the same quantity of catalyst for a given hourly space velocity in the isomerization reactor [1].

The products (or outputs) from the processes are defined as the mixture of overhead products (19) and bottom products (18) from the deisohexanizer [5], and the overhead product (15) from the head of the deisopentanizer [3] enriched in isopentane.

The compositions of the products obtained are summarized in Tables 2 to 4 below:

TABLE 2

| Composition of product obtained from stream 19 (DiH overhead) | | | | |
|---|---|---|---|---|
| | | Figure 1 | Figure 3 | Figure 4 |
| Mass flow rate | kg/h | 21890 | 21855 | 21875 |
| i-pentane | % by wt | 0 | 0 | 0 |
| n-pentane | % by wt | 2 | 2 | 1 |
| 2,2-dimethylbutane | % by wt | 56 | 58 | 55 |
| 2,3-dimethylbutane | % by wt | 12 | 12 | 13 |
| 2-methylpentane | % by wt | 23 | 22 | 24 |
| 2-methylhexane | % by wt | 4 | 4 | 5 |
| cyclopentane | % by wt | 2 | 2 | 2 |

TABLE 3

| Composition of product obtained from stream 18 (DiH bottom) | | | | |
|---|---|---|---|---|
| | | Figure 1 | Figure 3 | Figure 4 |
| Mass flow rate | kg/h | 3166 | 3166 | 3166 |
| n-hexane | % by wt | 5 | 5 | 5 |
| methylcyclopentane | % by wt | 10 | 10 | 10 |
| cyclohexane | % by wt | 50 | 51 | 52 |
| C7+ | % by wt | 35 | 34 | 32 |

TABLE 4

| Composition of product obtained from stream 15 (DiP overhead) | | | | |
|---|---|---|---|---|
| | | Figure 1 | Figure 3 | Figure 4 |
| Mass flow rate | kg/h | 11244 | 11255 | 11288 |
| butanes | % by wt | 3 | 2 | 2 |
| isopentane | % by wt | 94 | 94 | 92 |
| n-pentane | % by wt | 3 | 3 | 5 |

Table 5 below compares the results obtained with the different variations of the layout in accordance with the prior art and in accordance with the invention. The notes for Table 5 are as follows:

1: yield, defined as the mass flow rate of product divided by the flow rate of fresh feed.

2: thermal exchange with the bottom of the stabilization column.

3: the supply and withdrawal plates are in numerical order, numbered from top to bottom starting with the numeral 1.

TABLE 5

| Comparison of various layouts | | | |
|---|---|---|---|
| | Figure 1 (prior art) | Figure 3 (invention) | Figure 4 (invention) |
| Stabilization column [2] | | | |
| Number of theoretical plates | 19 | 19 | 19 |
| Supply plate [3] | 7 | 7 | 7 |
| Power required at reboiler (MW) | 4.9 | 4.9 | 4.8 |
| Reflux ratio/flow rate of distillate | 2.9 | 2.9 | 2.9 |
| Upper section diameter (mm) | 1250 | 1250 | 1250 |
| Lower section diameter (mm) | 2450 | 2450 | 2450 |
| Deisohexanizer [5] | | | |
| Number of theoretical plates | 62 | 62 | 62 |
| Supply plate [3] | 20 | 20 | 20 |
| Power required at reboiler (MW) | 10.8 | 10.8 | 10.8 |
| Power required at intermediate reboiler (MW, plate 41) [2] | 2.6 | 2.6 | 2.6 |

TABLE 5-continued

| Comparison of various layouts | | | |
|---|---|---|---|
| | Figure 1 (prior art) | Figure 3 (invention) | Figure 4 (invention) |
| Reflux ratio/distillate | 5.9 | 5.6 | 6.0 |
| Intermediate withdrawal plate[3] | 38 | 38 | 38 |
| Diameter (mm) | 3500 | 3500 | 3500 |
| Depentanizer [4] | | | |
| Number of theoretical plates | 27 | 27 | N/A |
| Supply plate [3] | 13 | 13 | N/A |
| Power required at reboiler (MW) | 7.63 | 6.8 | N/A |
| Reflux ratio/distillate | 4.5 | 11.1 | N/A |
| Diameter (mm) | 2900 | 2750 | N/A |
| Deisopentanizer [3] | | | |
| Number of theoretical plates | 52 | 42 | 59 |
| Supply plates [3] | 23/50 | 29 | 42 |
| Power required at reboiler (MW) | 9.2 | 9.1 | 9.3 |
| Reflux ratio/distillate | 5.8 | 9.0 | 9.1 |
| Intermediate withdrawal plates [3] | N/A | N/A | 29 |
| Diameter (mm) | 2450 | 2750 | 2900 |
| Pentanes recycle ratio | 0.67 | 0.67 | 0.60 |
| Hexanes recycle ratio | 0.49 | 0.20 | 0.26 |
| Research Octane Numbers of product | 89.68 | 89.87 | 89.52 |
| Yield [1] | 0.975 | 0.974 | 0.975 |
| Mass flow rate at isomerization reactor (kg/h) | 70388 | 70659 | 70298 |
| Total reboiler power (MW) | 32.5 | 31.6 | 24.9 |

The following conclusions can be drawn from Table 5:

1: The layout with a deisopentanizer and a depentanizer in accordance with the invention (FIG. 3), compared with the prior art with these same columns (FIG. 1), has smaller dimensions for the columns and the requirements for hot utilities. This necessarily results in lower investment and operational costs. In addition, the octane number obtained is better.

2: The layout in accordance with the invention of FIG. 4, with a single column [3] carrying out the roles of deisopentanizer and depentanizer, and 3 cuts extracted from said column, has an advantage in terms of investment compared with the use of two distinct columns and demonstrates that for an octane number and a yield close to the prior art, the hot utilities requirement is greatly reduced.

Example 2

The operating conditions for the reaction section remained the same as in Example 1.

Table 6 below presents the results of a thermal integration between the deisohexanizer [5] and the deisopentanizer [3] and the depentanizer [4] in accordance with the invention.

In the layout of FIG. 3, the deisohexanizer [5] was operated at a pressure of 8 bar absolute; the condensation temperature of the head of the column was thus 127° C. An exchange of heat was thus possible between this column head and the reboiler of the depentanizer [4] operated at 87° C. and the reboiler of the deisopentanizer [3] operated at 109° C.

In the layout of FIG. 4, the deisohexanizer [5] was operated at a pressure of 8 bar; the condensation temperature of the column head was thus 127° C. An exchange of heat was then possible between this column head and the reboiler of the deisopentanizer [3] operated at 115° C.

TABLE 6

Results of thermal integration in accordance with Example 2

| | Figure 3 with thermal integration DiH with DP and DiP (invention) | Figure 4 with thermal integration DiH with 3-cut DiP (invention) |
|---|---|---|
| Stabilization column [2] | | |
| Number of theoretical plates | 19 | 19 |
| Power required at reboiler (MW) | 4.9 | 4.8 |
| Reflux ratio/distillate | 2.9 | 2.9 |
| Upper section diameter (mm) | 1250 | 1250 |
| Lower section diameter (mm) | 2450 | 2450 |
| Deisohexanizer [5] | | |
| Number of theoretical plates | 87 | 87 |
| Supply plate | 27 | 27 |
| Power required at reboiler (MW) | 16.5 | 15.3 |
| Power required at intermediate reboiler (MW, plate 59) [3] | 0.8 | 0.9 |
| Reflux ratio/distillate | 8.5 | 8.5 |
| Intermediate withdrawal plates | 56 | 56 |
| Diameter (mm) | 3500 | 3500 |
| Depentanizer [4] | | |
| Number of theoretical plates | 27 | N/A |
| Supply plate | 13 | N/A |
| Power required at reboiler (MW) [1] | 6.8 | N/A |
| Reflux ratio/distillate | 11.2 | N/A |
| Diameter (mm) | 2750 | N/A |
| Deisopentanizer [3] | | |
| Number of theoretical plates | 42 | 59 |
| Supply plate | 30 | 42 |
| Power required at reboiler (MW) [1] | 8.1 | 10.2 |
| Reflux ratio/distillate | 9.7 | 11.3 |
| Intermediate withdrawal plates | N/A | 29 |
| Diameter (mm) | 2900 | 3200 |
| Pentanes recycle ratio | 0.67 | 0.59 |
| Hexanes recycle ratio | 0.19 | 0.27 |
| Research Octane Numbers of product | 89.64 | 89.50 |
| Yield [2] | 0.974 | 0.976 |
| Mass flow rate at isomerization reactor (kg/h) | 70600 | 70597 |
| Total reboiler power (MW) | 21.4 | 20.1 |

The notes for Table 6 are as follows:

1: requirements covered by the condensation at the head of the deisohexanizer [5] without the need for hot utilities.

2: yield, defined as the mass flow rate of product divided by the flow rate of fresh feed.

3: thermal exchange with the bottom of the stabilization column [2].

The requirements for hot utilities in the layout in accordance with FIG. 3 were reduced by 10.2 MW (31.6 MW to 21.4 MW).

The requirements for hot utilities in the layout in accordance with FIG. 4 were reduced by 4.8 MW (24.9 MW to 20.1 MW).

Because of a moderate overinvestment for the DiH column [5], these thermal integrations significantly reduced the operating costs without altering the performance of the unit.

Example 3

The operating conditions for the reaction section [1] remained the same as in Example 1. The layout of the process was that of FIG. 3 supplemented by the thermal integration detailed in FIG. 6.

The depentanizer [4] was operated at a pressure of 11 bar absolute; the condensation temperature of the column head was thus 123° C. An exchange of heat was thus possible between this column head and the reboiler of the deisopentanizer [3] operated at 109° C. Table 7 details the results obtained.

The notes for Table 7 are as follows:

1: of which 7.5 MW covered by the condensation at the head of the deisohexanizer without the need for hot utilities.

2: requirements covered by the condensation at the head of the deisohexanizer without the need for hot utilities.

3: thermal exchange with the bottom of the stabilization column.

TABLE 7

Results of thermal integration in accordance with Example 3

| | Figure 3 + 6 with thermal integration of DiP with DP (invention) |
|---|---|
| Stabilization column [2] | |
| Number of theoretical plates | 19 |
| Supply plate | 7 |
| Power required at reboiler (MW) | 4.9 |
| Reflux ratio/distillate | 2.9 |
| Upper section diameter (mm) | 1250 |
| Lower section diameter (mm) | 2450 |
| Deisohexanizer [5] | |
| Number of theoretical plates | 62 |
| Supply plate | 20 |
| Power required at reboiler (MW) | 9.7 |
| Intermediate reboiler duty (plate 40) [3] | 2.6 |
| Reflux ratio/distillate | 6.5 |
| Intermediate withdrawal plates | 38 |
| Diameter (mm) | 3700 |
| Depentanizer [4] | |
| Number of theoretical plates | 43 |
| Supply plate | 21 |
| Power required at reboiler (MW) | 9.8 |
| Reflux ratio/distillate | 12.5 |
| Diameter (mm) | 3000 |
| Deisopentanizer [3] | |
| Number of theoretical plates | 42 |
| Supply plates | 29 |
| Power required at reboiler (MW) | 9.1 [1] |
| Reflux ratio/distillate | 9.0 |
| Intermediate withdrawal plates | N/A |
| Diameter (mm) | 2750 |
| Pentanes recycle ratio | 0.67 |
| Hexanes recycle ratio | 0.20 |
| Research Octane Numbers of product | 89.52 |
| Yield [2] | 0.975 |
| Mass flow rate at isomerization reactor (kg/h) | 70787 |
| Total reboiler power (MW) | 26.0 |

The hot utilities requirements for the layout in accordance with FIG. 6 were reduced by 5.6 MW (31.6 MW to 26.0 MW).

Because of a moderate overinvestment for the depentanizer [4], this thermal integration significantly reduced its operating costs without altering the performance of the unit.

The invention claimed is:

1. A process for the isomerization of a light naphtha, said process comprising an isomerization reaction step (1), said step being carried out under the following conditions:

a temperature in the range 100° C. to 300° C., a pressure of 2 to 35 bar (1 bar=0.1 MPa), and a molar ratio of hydrogen/hydrocarbons in the range 0.1/1 to 1/1, a space velocity of 0.5 to 10 $h^{-1}$, the catalysts used being constituted by a support of high purity alumina comprising 2% to 10% by weight of chlorine, 0.1% to 0.40% by weight of platinum, and optional other metals, said isomerization step being followed by a step (2) for stabilization of the reaction effluents, and by two steps for separation by distillation of the bottom stream obtained from the stabilization step (2) which are placed downstream of the stabilization step (2), the two separation steps being as follows:

1—a first step for separation by distillation (block (3+4) in order to separate the hydrocarbons containing 5 carbon atoms from heavier compounds sent towards the second section for distillation by separation (5), said first separation step producing the following 3 cuts: a) a cut which is enriched in isopentane (15) which is a product of the process, b) a cut which is enriched in n-pentane (16) which is recycled to the reaction section (1), and c) a cut which is enriched in hydrocarbons which are heavier than pentanes (17), which is directed towards a second separation step (5), (5), consisting of a separation column wherein the overhead stream (19) which is rich in C6 branched compounds and bottom stream (18), are the products from the unit and an intermediate cut (20) which is enriched in n-hexane, removed as a side stream which is recycled to the reaction section (1), in which in an isomerization process an exchange of heat is carried out between a condenser of one of the columns (3), (4) or (5) and the reboiler of one of columns (3), (4) or (5).

2. The light naphtha isomerization process according to claim 1, in which the first separation step comprises two columns, a deisopentanizer (3) and a depentanizer (4), disposed in series, wherein the bottom stream (14) from the deisopentanizer (3) is supplied to the depentanizer (4), the stream of isopentane (15) leaves from the head of the column (3), a stream enriched in hydrocarbons which are heavier than pentanes (17) leaves from the bottom of the column (4) and is supplied to the deisohexanizer (5), and the overhead stream (16) from the column (4) is recycled to the isomerization unit (1).

3. A process for the isomerization of a light naphtha, said process comprising an isomerization reaction step (1), said step being carried out under the following conditions:

a temperature in the range 100° C. to 300° C., a pressure of 2 to 35 bar (1 bar=0.1 MPa), and a molar ratio of hydrogen/hydrocarbons in the range 0.1/1 to 1/1, a space velocity of 0.5 to 10 $h^{-1}$, the catalysts used being constituted by a support of high purity alumina comprising 2% to 10% by weight of chlorine, 0.1% to 0.40% by weight of platinum, and optional other metals, said isomerization step being followed by a step (2) for stabilization of the reaction effluents, and by two steps for separation by distillation of the bottom stream obtained from the stabilization step (2) which are placed downstream of the stabilization step (2), the two separation steps being as follows:

the first separation step comprises just a single column (3), in which a stream of isopentane (15) leaves column (3) overhead, a stream enriched in hydrocarbons which are heavier than pentanes (17) leaves from the bottom of said column (3) and is supplied to the column of a deisohexanizer (5), and an intermediate withdrawal (stream 16) is recycled to an isomerization unit (1), and a second separation step (5), consisting of a separation column wherein the overhead stream (19) which is rich in C6 branched compounds and bottom stream (18) are the products from the unit, and an intermediate cut (20) which is enriched in n-hexane, is removed as a side stream which is recycled to the reaction section (1), in which in an isomerization process an exchange of heat is carried out between a condenser of one of the columns (3), (4) or (5) and the reboiler of one of columns (3), (4) or (5).

4. The light naphtha isomerization process according to claim 1, in which the first separation step comprises the two columns (4) and (3) disposed in series in that order, the stream (12) obtained from the stabilization column (2) is supplied to the depentanizer (4) from which an overhead stream (21) leaves which is supplied to the deisopentanizer (3), and the bottom stream (17) from the depentanizer (4) which is enriched in hydrocarbons which are heavier than pentanes (17) is supplied to the deisohexanizer (5), the deisopentanizer (3) producing the overhead stream (15) which is rich in isopentane, and the stream (16) from the bottom, which is rich in normal pentane, which is recycled to the isomerization unit (1).

5. The light naphtha isomerization process according to claim 1, in which an exchange of heat is carried out between a condenser of the deisohexanizer (5) and either a reboiler of the depentanizer (4) or a reboiler of the deisopentanizer (3), or both.

6. The light naphtha isomerization process according to claim 1, in which an exchange of heat is carried out between the condenser of the depentanizer (4) and the reboiler of the deisopentanizer (3).

7. The light naphtha isomerization process according to claim 1 wherein the space velocity is 1 to 4 $h^{-1}$.

8. The light naphtha isomerization process according to claim 1 wherein the temperature is in the range 110° C. to 240° C.

* * * * *